US005830284A

United States Patent [19]

Kühn

[11] Patent Number: 5,830,284

[45] Date of Patent: Nov. 3, 1998

[54] METHOD AND DEVICE FOR THE HEAT TREATMENT OF WORKPIECES

[75] Inventor: Friedhelm Kühn, Mülheim, Germany

[73] Assignee: LOI Thermprocess GmbH, Essen, Germany

[21] Appl. No.: 553,710

[22] PCT Filed: May 13, 1994

[86] PCT No.: PCT/EP94/01542

§ 371 Date: Apr. 15, 1996

§ 102(e) Date: Apr. 15, 1996

[87] PCT Pub. No.: WO94/29491

PCT Pub. Date: Dec. 22, 1994

[30] Foreign Application Priority Data

Jun. 3, 1993 [DE] Germany ..... 43 18 400.6

[51] Int. Cl.[6] ..... C23C 8/20

[52] U.S. Cl. ..... 148/206; 148/233; 432/72; 432/175; 432/176; 432/179

[58] Field of Search ..... 432/179, 180, 432/181, 175, 176, 72; 148/206, 233

[56] References Cited

U.S. PATENT DOCUMENTS

| | | | |
|---|---|---|---|
| 3,207,493 | 9/1965 | Swain | 432/180 |
| 3,712,597 | 1/1973 | Waitkus et al. | 432/180 |
| 3,870,474 | 3/1975 | Houston | 432/180 |
| 3,957,418 | 5/1976 | Sata | 431/9 |
| 4,217,091 | 8/1980 | Whike et al. | 432/72 |
| 4,219,324 | 8/1980 | Zahniser | 432/72 |

*Primary Examiner*—Teresa J. Walberg
*Assistant Examiner*—Jiping Lu
*Attorney, Agent, or Firm*—Blakely Sokoloff Taylor & Zafman

[57] ABSTRACT

The present invention involves a method and a device for the heat treatment of workpieces, which are heated with radiant heat generated through the combustion of gaseous fuel. Some of the workpieces are subjected to a carburisation atmosphere formed by a heated mixture of hydrocarbon containing gas and carbon dioxide, where the carbon dioxide has been separated from the exhaust gas of the gaseous fuel combustion. Other workpieces may be subjected to a nitro-carburisation atmosphere formed by a mixture of ammonia and the exhaust gas remaining after the carbon dioxide has been separated. By recycling some of the products of the combustion process, the present invention improves the efficiency of the carburisation process while reducing pollutant emissions.

6 Claims, 1 Drawing Sheet

METHOD AND DEVICE FOR THE HEAT TREATMENT OF WORKPIECES

FIELD OF THE INVENTION

The present invention relates to a method and a device for the heat treatment of workpieces, wherein the workpieces are heated with radiant heat which is generated through the combustion of gaseous fuel, in particular natural gas, and wherein at least some of the workpieces are subjected to a carburisation atmosphere.

BACKGROUND OF THE INVENTION

Such carburisation methods and devices known from practice have a relatively high energy requirement. Thus, those skilled in the art are continually striving to improve the cost-effectiveness of carburisation processes. At the same time, the environmental protection requirements have also to be considered. Great importance is attached to the reduction of pollutant emissions. However, such emission reduction measures are cost-intensive and thus run counter to the efforts to improve cost-effectiveness.

SUMMARY OF THE INVENTION

The object of the present invention was to optimise the carburisation process under these aspects, i.e. to reduce the pollutant emissions and at the same time to improve process control at least to such an extent that there is no appreciable negative effect on cost-effectiveness.

This object is achieved by the method according to the present invention characterised in that carbon dioxide is separated out of the exhaust gas which forms during the combustion of the gaseous fuel, that the carbon dioxide is mixed with hydrocarbon-containing gas, in particular with natural gas, and that the gas mixture is heated to produce the carburisation atmosphere.

The impact on the environment is quite considerably reduced through the removal of the carbon dioxide from the exhaust gases of the radiant heating system. The share of carbon dioxide in the exhaust gas is approx. 11%. Most of said carbon dioxide can be removed. With the appropriate process control the remaining exhaust gas only contains less than 1% carbon dioxide after the treatment.

The carbon dioxide is fed to the carburisation process as a supplier of oxygen and carbon with the effect that the carburisation time is considerably reduced, namely by 20 to 40%. The carburisation time depends on the temperature, the diffusion coefficient and the mass transfer coefficient. At a given temperature the two latter coefficients govern the speed of the carburisation process, in the case of small or medium-sized carburisation depths (0.2 to approx. 0.8 or 1.0 mm) said coefficients having equal ranking. The present invention has a particularly favourable effect in this range. It leads to an increase in the mass transfer coefficient by a factor of roughly 2.5.

A particular advantage of the present invention consists in the fact that the entire process can be operated continuously, it being possible, if necessary, to place the carbon dioxide removed in an intermediate store.

The carburisation atmosphere is generated by an endothermic reaction. The heat necessary herefor is preferably removed from the radiant heat which is used for heating the workpieces. This can, for example be achieved by introducing the mixture of carbon dioxide and hydrocarbon-containing gas directly into the furnace chamber. However, with this procedure there is the danger of inadmissible soot formation occurring. Therefore, it is more advantageous to pass the gas mixture over a catalyst which ensures that the endothermic reaction can take place without the formation of soot. The catalyst also ensures optimal intermixing of the components. The endogas generator can be arranged outside the furnace chamber. However, then a separate heating system is generally necessary. Therefore it can be more advantageous to arrange the generator in the furnace chamber, preferably in the furnace roof area, i.e. where a high temperature prevails and also where the fans are located.

A further embodiment of the present invention proposes that the carbon dioxide is removed from the exhaust gas formed during combustion of the gaseous fuel by changes in pressure. This method makes use of the pressure-dependent attachment properties of carbon dioxide, for example, to molecular sieves. It can be easily integrated into the continuous process and is low in cost.

Carbon dioxide and water form during the carburisation reaction. As this reaction proceeds particularly rapidly with the method according to the present invention, a local excess of reaction products may occur leading to undesired surface zone oxidisation of the workpieces. In order to counteract this effect the present invention proposes that the carburisation atmosphere be injected with heavy hydrocarbon. The slow-reacting methane, which is preferably used in the form of natural gas, is particularly capable of blanketing the products of the carburisation reaction and preventing oxidisation of the material. At the same time it is ensured that the carbon level in the carburisation atmosphere is maintained. To prevent surface zone oxidisation it must be ensured that the heavy hydrocarbon can make its way to the workpieces so as to shield the endangered surfaces. Here a local hydrocarbon concentration of 4 to 6% should be established.

The exhaust gas from the radiant heating system remaining after the removal of the carbon dioxide can be used as purging gas, for example for inertisation of locks. A major embodiment of the present invention proposes that said remaining exhaust gas be used for nitrocarburising part of the workpieces, with the addition of ammonia. Normally, it is customary to use not only ammonia but also bought-in nitrogen and bought-in carbon dioxide for nitrocarburisation. With the present invention the two latter constituents are provided by the remaining exhaust gas in the process. This further improves cost-effectiveness and thus leads to a considerable increase in the desired optimisation effect. The nitrocarburisation process can be readily integrated into the continuous process as a whole. The removal of carbon dioxide from the exhaust gas of the radiant heating system is set so that both the requirements of the carburisation process and those of the nitrocarburisation process are taken into account. This gives a process which is both extremely cost-effective and extremely environmentally friendly.

Furthermore, the present invention provides for a device for the heat treatment of workpieces with at least one furnace chamber, which is provided with gas-operated radiant heating tubes, and with a generator for producing carburisation gas for the furnace chamber, wherein said device is characterised in that the radiant heating tubes are connected by their exhaust gas pipes to a pressure-change device and that the pressure-change device is connected by its carbon dioxide outlet pipe to the generator. The pressure-change device removes carbon dioxide from the exhaust gas of the radiant heating tubes, whereupon the carbon dioxide enters the generator as a supplier of oxygen and carbon to react there endothermically with a carbon-containing gas, preferably natural gas. For the purposes of heating the generator, it is preferable for said generator to be arranged in the furnace chamber, namely in the roof area thereof.

A major embodiment of the present invention proposes that the pressure-change device be connected by its remaining exhaust gas outlet pipe to a second furnace chamber which has an ammonia inlet pipe and serves to nitrocarburise part of the workpieces which are not to be carburised. The joint control system ensures that the individual processes are synchronised with each other and run continuously.

Gas-operated radiant heating tubes are also generally used for heating the second furnace chamber. It is particularly advantageous to also connect their exhaust gas pipes to the pressure-change device so that the exhaust gas is subjected to the same treatment as the exhaust gas from the radiant heating tubes operating in the carburisation chamber.

Combinations of the features according to the present invention which deviate from the combinations discussed hereinbefore shall be deemed to have been disclosed as essential to the present invention.

BRIEF DESCRIPTION OF THE DRAWING

The present invention will now be described in greater detail with the aid of a preferred embodiment of a device according to the present invention and the attached drawing. The drawing shows a schematic block diagram.

DETAILED DESCRIPTION OF THE INVENTION

Figure 1:
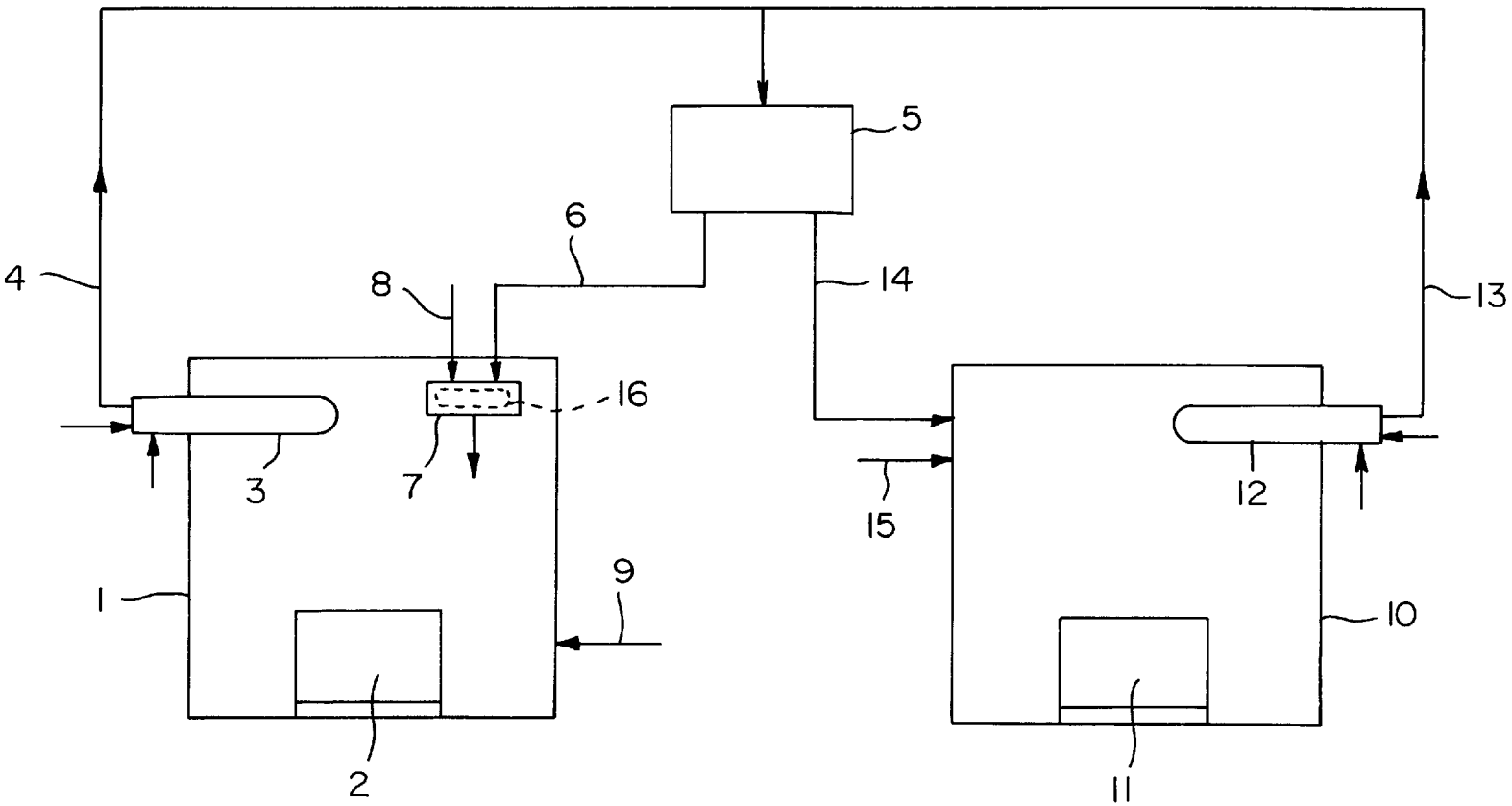

With reference to the drawing, the device has a first furnace chamber 1 which is used for carburising workpieces 2 and which is heated by gas-operated radiant heating tubes 3. The latter are connected via their exhaust gas pipes 4 to a pressure-change device 5.

Carbon dioxide is removed from the exhaust gas of the radiant heating tubes 3 in the pressure-change device 5. The carbon dioxide enters a generator 7 via an outlet pipe 6, said generator also being fed with natural gas via a pipe 8. As the generator 7 is arranged in the furnace chamber, it is heated by the radiant heating tubes 3. The natural gas reacts with the carbon dioxide in the generator 7. The endogas generated thereby enters the furnace chamber 1 and causes the workpieces 2 to be carburised.

In this manner the exhaust gas from the radiant heating tubes 3 is freed of carbon dioxide. Thus the impact on the environment is reduced. The carbon dioxide is also used for the generation of endogas which increases the mass transfer coefficient and thus leads to a considerable increase in the speed of carburisation. This improves the cost-effectiveness of the carburisation process.

A local excess of carbon dioxide and steam may form on the material surfaces due to the acceleration of carburisation. Methane is introduced into the furnace chamber 1 at a suitable point—schematically shown by a pipe 9—to buffer said excess.

The device also has a second furnace chamber 10 which is used for nitrocarburising workpieces 11. The second furnace chamber is heated by radiant heating tubes 12. These are also connected by their exhaust gas pipes 13 to the pressure-change device 5. Thus, they also help to supply the generator 7 with carbon dioxide.

The pressure-change device 5 has an outlet pipe 14 which is used for introducing the remaining exhaust gas from the radiant heating tubes 3 and 12 into the second furnace chamber. The remaining exhaust gas still contains some carbon dioxide and also some nitrogen. Together with ammonia, which is fed in through a pipe 15, the remaining exhaust gas forms the atmosphere for nitrocarburisation of the workpieces 11.

A control system not shown in the drawing ensures that the carbon dioxide content of the exhaust gases in the pressure-change device is divided between furnace chambers 1 and 10 in accordance with the relevant carbon dioxide requirements. Furthermore, the control system ensures synchronisation of the individual processes such that the entire process can be operated continuously.

Modifications are perfectly possible within the scope of the present invention. For example, the second furnace chamber 10 can be dispensed with. Instead the remaining exhaust gas from the pressure-change device 5 can be used for inertisation of locks or similar. Furthermore, the generator 7 can be arranged outside the furnace chamber 1. However, an additional heating system is then necessary. The generator 7 can be entirely dispensed with. The carbon dioxide coming from the pressure-change device 11 is under these circumstances fed directly into the furnace chamber mixed with the natural gas.

I claim:

1. A method for the heat treatment of workpieces, said method comprising the steps of:

a) heating said workpieces with radiant heat which is generated through the combustion of gaseous fuel, in particular natural gas;

b) subjecting at least some of said workpieces to a carburisation atmosphere;

c) separating carbon dioxide out of exhaust gas formed during said combustion of said gaseous fuel;

d) mixing said carbon dioxide with hydrocarbon-containing gas, in particular natural gas, to create a gas mixture; and e) heating said gas mixture to produce said carburisation atmosphere.

2. The method according to claim 1, wherein said gas mixture is heated with said radiant heat used to heat said workpieces.

3. The method according to claim 1 or 2, wherein said gas mixture is passed over a catalyst.

4. The method according to claim 1, wherein said carbon dioxide is removed by pressure change from said exhaust gas formed during said combustion of said gaseous fuel.

5. The method according to claim 1, wherein said carburisation atmosphere is injected with heavy hydrocarbon.

6. The method according to claim 1, wherein the rest of said exhaust gas remaining after the removal of said carbon dioxide is used for nitrocarburisation of some of said workpieces, ammonia being added.

* * * * *